United States Patent [19]

Löfgren

[11] 4,396,389

[45] Aug. 2, 1983

[54] METHOD OF MANUFACTURING A FABRIC HAVING SOIL-RELEASE PROPERTIES, PARTICULARLY FORMING FABRICS USED IN PAPERMAKING MACHINES AND CELLULOSE MACHINES, AND FILTER CLOTHS USED IN THE PAPERMAKING AND CELLULOSE INDUSTRIES AND RELATED INDUSTRIES

[75] Inventor: Per A. Löfgren, Gullbrandstorp, Sweden

[73] Assignee: Nordiskafilt AB, Sweden

[21] Appl. No.: 351,157

[22] Filed: Feb. 22, 1982

[30] Foreign Application Priority Data

Mar. 5, 1981 [SE] Sweden ..... 8101413

[51] Int. Cl.[3] ..... D06B 1/00

[52] U.S. Cl. ..... 8/115.5; 162/DIG. 1; 264/210.6; 264/211; 428/265

[58] Field of Search ..... 8/115.5; 264/210.2, 264/210.6, 211; 162/DIG. 1

[56] References Cited

U.S. PATENT DOCUMENTS 4,063,887 12/1977 Forscherm ..... 8/115.5

*Primary Examiner*—James J. Bell

*Attorney, Agent, or Firm*—Kane, Dalsimer, Kane, Sullivan & Kurucz

[57] ABSTRACT

A method of improving the soil-repellant properties of fabrics such as forming fabrics used in papermaking and cellulose machines, and filter cloths used in pa;permaking and cellulose industries and related industries. The improvement in accordance with the invention is obtained in that the synthetic material from which these fabrics are manufactured, is given improved hydrophilic properties, which in turn is achieved in that the synthetic starting material, prior to being extruded, is mixed with polymers which are made up of monomers having hydrolizable side groups. The fabric manufactured from the synthetic material is treated in a manner known per se with strong bases and or/acids to hydrolize the side groups.

15 Claims, No Drawings

METHOD OF MANUFACTURING A FABRIC HAVING SOIL-RELEASE PROPERTIES, PARTICULARLY FORMING FABRICS USED IN PAPERMAKING MACHINES AND CELLULOSE MACHINES, AND FILTER CLOTHS USED IN THE PAPERMAKING AND CELLULOSE INDUSTRIES AND RELATED INDUSTRIES

BACKGROUND OF THE INVENTION

The invention concerns a method of improving the soil-release properties of a fabric consisting of synthetic fibres and/or thread materials. The invention is applicable to a large number of various types of weaves of different materials and types of threads but it is primarily designed to improve polyester monofilaments used in the manufacture of forming fabrics for papermaking and cellulose machines and for filter cloths used in the papermaking and cellulose industries and related industries. The improvement consists of the addition to the fibrous and/or thread material of polymers of a kind that make it possible to improve considerably the hydrophilic properties of the fabric compared with those hitherto obtainable in prior-art fabrics.

The invention will be described with reference to its applications in forming fabrics for the purpose of improving the soil-repellant properties of such fabrics. The impurities present in the paper pulp which is dewatered in the wet section of the papermachine have a tendency to clog the wire, the latter therefore having to be cleaned from time to time. Usually, the cleaning is effected by spraying the wire by means of powerful water jets (high-pressure jet sprays), which has a strong wearing effect on the fabric. It has therefore been customary to subject the fabrics to a treatment making them soil-repellant. The impurities most commonly found in paper pulps are oily or tarry soils. Consequently, the fabric will be soil-repellant, if its hydrophilic properties are increased, that is, if its wetting properties are improved. Hitherto, this has been achieved by treating the fabric with caustic soda, since the fabrics commonly used today often consist of polyester monofilaments, and by treating such fabrics with caustic soda the polyester is hydrolized, increasing the wetting properties of the filaments. However, treatments of this kind have an effect only on the surface layer of the filaments, and this surface layer is soon worn off or rendered ineffective.

Attempts have also been made to use direct hydrophilic surface treatments of the fibrous and/or thread material, primarily by coating the surface with a hydrophilic type of latex. However, treatments of this kind require large quantities of chemicals and careful supervision. Just as is the case in caustic soda treatments this surface-coating treatment affects only the surface layer of the filament and the coating is worn off after a short period of use.

For certain types of fabrics admixture of initially hydrophilic substances prior to extrusion has been discussed. Since extrusion must be carried out in an environment that is absolute void of moisture there are considerable problems of a process-technical nature that must be solved to effect admixture of moisture-absorbing substances. These problems are most prominent in the extrusion of monofilament threads of the kind used in forming fabrics and filter cloths.

SUMMARY OF THE INVENTION

The subject invention has for its purpose to improve the hydrophilic properties of the synthetic fibres and/or threads that form the fabric. To achieve this purpose the invention is characterised in that before being extruded the synthetic starting material is mixed with polymers of a kind that are made up of monomers having hydrolizable side groups, and in that the fabric manufactured from the fibrous and/or thread materials thus extruded is treated in a manner known per se with strong bases and/or acids to hydrolize said side groups.

Further characteristics of the invention will appear from the dependent claims according to which the polymers could be added in amounts of up to 7%, calculated on the synthetic starting material and primarily consist of polymethacrylates, polyacrylates and polyvinyl acetates.

DETAILED DESCRIPTION OF A PREFERRED EMBODIMENT

To illustrate the merits of the invention and evaluate the improvements in hydrophilic properties obtained by the invention a monofilament material was produced from polyethylene terephthalate (PET). The diameter of the monofilaments was 0.17 millimeter. One of the samples, identified as Sample O, was produced in the conventional manner exclusively from PET without admixture of other substances. A second sample, identified as Sample F, was produced in an identical manner with the exception that prior to extrusion, polymethylmethacrylate was added in an amount of 4%, calculated on the weight of the starting material. Polymethylmethacrylate is a polymer which is made up of monomers having hydrolizable side groups and in this original form it exhibits no pronounced hydrophilic properties.

A part-sample from Sample O as well as from Sample F were treated with 20% sodium hydroxide for 16 h whereas another part-sample of each kind were tested without having been exposed to the caustic soda treatment.

In summary, the following four samples thus were produced:

- Sample O (untreated)—Conventional polyethylene terephthalate (PET), untreated
- Sample O (treated)—Conventional polyethylene terephthalate (PET), treated with 20% sodium hydroxide for 16 h
- Sample F (untreated)—Polyethylene terephthalate (PET) mixed with 4% polymethylmethacrylate, untreated
- Sample F (treated)—Polyethylene terephthalate (PET) mixed with 4% polymethylmethacrylate treated with 20% sodium hydroxide for 16 h.

The wettability of the above monofilament samples was tested, following the procedure described in e.g. "Textile Research Journal", issue 45, p. 359–365 from 1975. A short (appr. 1 cm) length of monofilament was cemented to an aluminium tab and suspended vertically in a micro-balance. A beaker of distilled water was raised slowly (appr. 0.25 mm/minute) until the vertical fibre was immersed to a depth of 4–5 mm, and then the beaker was lowered at the same speed until the fibre no longer contacted the water. This cycle was then repeated so that each fiber tested was immersed and withdrawn twice. At least two specimens of each type of fibre submitted were tested in this way.

The weight of the fiber and the suspension tab was weighed in air and the changes in weight were registered by the micro-balance during the immersion-withdrawal cycles and were plotted by a recorder. The micro-balance registers a composite force, viz. an upward force component due to the buoyancy of the fiber in water, which will increase as the depth of immersion is increased and decrease again as the fiber is withdrawn from the water, and the vertical component of the liquid surface tension, which will be downward if the contact angle $\theta<90°$, upward if $\theta>90°$, and zero if $\theta=90°$.

The table below indicates the results obtained in these tests.

| Sample Identification | Specimen No. | Wetting Force (mN/m) Immersion | Withdrawal |
|---|---|---|---|
| O Sample (untreated) | 1 | 5.5 | 36.7 |
| | 2 | 3.7 | 36.1 |
| | Mean | 4.6 | 36.4 |
| O Sample (treated) | 1 | 6.3 | 69.5 |
| | 2 | 4.3 | 61.8 |
| | Mean | 5.3 | 65.7 |
| F Sample (untreated) | 1 | 2.6 | 59.0 |
| | 2 | 6.4 | 56.9 |
| | Mean | 4.5 | 57.9 |
| F Sample (treated) | 1 | 16.5 | 73.3 |
| | 2 | 25.2 | 79.9 |
| | Mean | 20.9 | 76.6 |

The above results show that a certain improved effect is obtained by conventional caustic soda treatments. The addition of polymers in accordance with the subject invention does not bring about an improvement in itself compared with caustic soda treatments of the conventional Sample O. The admixture of polymethylmethacrylate in combination with sodium hydroxide as taught by the subject invention does, however, considerably improve the wetting force.

In manufacturing fibers and monofilaments in accordance with the invention the following process steps are carried out:

(a) The starting material is mixed with polymers and dried. Polymers in amounts of up to 7%, preferably between 2 and 5%, can be added without significantly altering the properties of the polyester.

(b) Extrusion of the modified polyester in the conventional manner. Both warp and weft threads can be produced.

(c) The fabric is woven and heat-set.

(d) The fabric is treated in a sodium hydroxide solution. This treatment can be replaced by or followed by an acid treatment to change the pH-value on the surface. In both cases the treatments should be followed by careful washing in water to avoid degradation of the monofilaments.

The treatment in accordance with the invention represents a technical improvement over the prior art in that the use of for instance polymethylmethacrylate or other substance as a blender as taught by the invention is not limited to effects on the very surface layer but is homogeneous throughout the entire cross-section of the fiber. The soil-release effect owing to the improved hydrophilic properties is easily reactivated when the forming wire is cleaned in caustic soda, which is a normal procedure in the art and is performed on the papermaking machine proper.

The polymers which in accordance with the invention are mixed into the basic material do not possess any actual hydrophilic properties in their basic form. Consequently, they are not sensitive to moisture absorption during the extrusion, and this process therefore can be carried out without complications. Only in the subsequent treatment when exposed to sodium hydroxide, are the side groups in the monomers hydrolized and does the hydrophilic property appear.

The invention is not limited to the examples given above but several modifications are possible within the scope of the appended claims.

What I claim is:

1. In a method of manufacturing a fabric possessing soil-release properties which comprises; extruding threads from a material comprising synthetic polymeric resins; manufacturing a fabric from the extruded threads; and treating the fabric to obtain soil-release properties, the improvement comprising;

mixing the material with a polymer prior to extruding said material, said polymer being made up of monomers having hydrolyzable side groups, and in treating said fabric manufactured from said thread applying a strong base and/or acid in order to hydrolyze said side groups.

2. The improved method according to claim 1, wherein treating said fabric is by applying a strong base to hydrolyze said side groups.

3. The improved method according to claim 1, wherein treating said fabric is by applying a strong acid to hydrolyze said side groups.

4. The improved method according to claim 1, wherein said treatment of said fabric is by applying a combination of bases and acids.

5. The improved method according to claim 1, wherein said polymer is mixed in amounts of up to 7% calculated on the weight of said material.

6. The improved method according to claim 5, wherein said polymer is a polymethacrylate.

7. The improved method according to claim 5, wherein said polymer is a polyacrylate.

8. The improved method according to claim 5, wherein said polymer is polyvinyl acetate.

9. The improved method according to claim 5, wherein said polymer is a copolymer made up of one or several of the monomers chosen from the group consisting of methacrylate, acrylate and vinylacetate.

10. The improved method according to claim 1, wherein said material is a thermoplastic polyester.

11. The improved method according to claim 10, wherein said thermoplastic polyester is polyethylene terephthalate.

12. The improved method according to claim 10, wherein said thermoplastic polyester is polybutylene terephthalate.

13. The improved method according to claim 1, wherein base is sodium hydroxide.

14. In a forming fabric used in papermaking and cellulose machines, and in filter cloths used in the papermaking and cellulose industries and related industries, said fabric and cloths being made from a synthetic filament, the improvement comprising said synthetic filament being extruded from a mixture of polymers comprising polymers made up of monomers having hydrolizable side groups, which are hydrolized through treatment with strong bases.

15. In a forming fabric used in papermaking and cellulose machines, and in filter cloths used in the papermaking and cellulose industries and related industries, said fabric and cloths being made from a synthetic filament, the improvement comprising said synthetic filament being extruded from a mixture of polymers comprising polymers made up of monomers having hydrolizable side groups, which are hydrolized through treatment with strong acids.

* * * * *